United States Patent [19]

Galbraith

[11] Patent Number: 4,828,193

[45] Date of Patent: May 9, 1989

[54] ONE HANDED SHEET HOLDER APPARATUS AND METHOD

[76] Inventor: Elton E. Galbraith, 1509 Bellaire, Austin, Tex. 78741

[21] Appl. No.: 138,068

[22] Filed: Dec. 28, 1987

[51] Int. Cl.[4] ..... B65H 19/00; B65H 35/10

[52] U.S. Cl. ..... 242/55.2; 225/80; 225/106

[58] Field of Search ..... 242/55.2; 225/46, 56, 225/77, 80, 90, 91, 88, 106

[56] References Cited

U.S. PATENT DOCUMENTS

| | | | |
|---|---|---|---|
| 4,289,262 | 9/1981 | Finkelstein | 225/106 |
| 4,441,642 | 4/1984 | Finkel | 225/77 X |
| 4,583,642 | 4/1986 | Blythe et al. | 225/106 X |
| 4,645,108 | 2/1987 | Gavin et al. | 225/106 |

*Primary Examiner*—David Werner
*Attorney, Agent, or Firm*—John N. Shaffer, Jr.

[57] ABSTRACT

A one handed sheet holder for enabling a user to tear off the desired amount of sheets from a roll single handedly. The sheet holder is conformed to be attached to a standard sheet dispensing means, such as a toilet paper dispenser, a paper towel dispenser, and the like. The sheet holder has one or more retaining slots cut into the top of the holder which are wider at the opening and narrower at the ending of the slot. As a result, sheets drawn into the slot are forced to the narrow ending, bunch, and tear leaving the end of the roll of the paper captured in the slot and the desired amount of paper for use in the user's hands. As a result, handicapped and other individuals can easily secure the desired amount of rolled sections of tissue single handedly. Further, the end of the roll is captured and displayed so that it can be simply and easily retained when further sections of paper are desired. The sheet holder is adapted for use with wall mounted roll dispensers known in the art, as well as recessed dispensers, paper towel dispensers and the like.

6 Claims, 2 Drawing Sheets

ONE HANDED SHEET HOLDER APPARATUS AND METHOD

BACKGROUND OF THE INVENTION

This invention relates to an improved sheet holder for enabling the user to unroll and retrieve individual sections of sheets using one hand.

Devices designed to hold rolls of sheet paper, plastic, and the like have been known in the art for quite some time. For example, toilet paper and paper towel dispensers are widely utilized. As anyone knows who has utilized these holders, occasionally a problem presents itself while using them. This particular problem is that the user may tug forcefully on the sheet roll in order to tear the sheet from the continuous section only to have a large quantity of the rolled sheets become unrolled instead of detaching the desired section from the roll. Various means and methods have been designed to prevent the unwanted unrolling of toilet paper and the like. An example of one invention used to hinder the rapid unrolling of toilet paper is embodied in Stern U.S. Pat. No. 3,850,379. Stern utilizes a "brake" accessory that consists of a spring clip that pushes against the side of a roll of paper thereby preventing the roll from "being unwound from the roll too quickly". Another example of an invention designed to limit the free rolling of roll holders is shown in Christian U.S. Pat. No. 4,239,163. The gist of this invention is a brake spindle inserted in the cardboard tube of a roll of tissue, which roll is then placed on a dispenser and limited in its free rolling by the pressure of a base plate against the arm of the roll holder thereby "producing a frictional force which prevents free rotation of the roll of tissue."

A drawback to the break mechanisms known in the art is that if the brakes are not adjusted correctly for each particular roll, and if the brake is too slack, the user still needs two hands to tear a section of paper from the roll, one to hold the roll and one to tear the section from the roll. If, on the other hand, the brake of the prior art inventions is too tight, sections of paper are torn from the roll one after another at a time when the user needs more tissue than is capable of being pulled from the roll due to the tight brake. Further, the free rolling motion of the paper rolls, as designed, is inhibited by means of intrusive mechanisms which generally require "tuning" to assure that proper tension is obtained and maintained. Thus, there is a need in the art for providing a sheet holder that does not interfere with the free rolling of sheet dispensers commonly used throughout the country. Further, there is a need in the art for providing a sheet holder apparatus that enables a person to remove a desired number of sheets from a roll of sheets while using only one hand to do so. It, therefore, is an object of this invention to provide a one handed sheet roller that does not interfere with the free rolling of sheet dispensers and which may be utilized single handedly whether through necessity or not.

SHORT STATEMENT OF THE INVENTION

Accordingly, the one handed sheet holder of the present invention includes a unitary sheet holding frame with a top and a bottom. The bottom of the sheet holder is conformed to be attached to typical sheet dispensing devices known in the art, such as paper towel and toilet paper dispensers. The top portion of the sheet holder is formed with a retaining slot with a wider opening and a narrower ending so that with one hand a user can introduce a section of a roll of paper into the wide opening, force the section into the narrow ending and thereby cause the sheet to bunch, tear apart, and leave a free end of the sheet in the slot for retrieval when more paper is desired, while leaving the desired portion of paper in the user's hand. The device may be constructed with a rounded guide portion located between a first and second slot in the holder constructed so that the first slot is vertical and the second slot is angled. As a result of this configuration, the user can select the slot that is most comfortable and convenient for use.

Further, the invention can be attached to the wall beside a dispenser, to the dispenser itself, to recessed dispensers, and to any known dispensers in use today.

Still further, the sheet holder can be attached so that the user can insert the desired section of sheets into the slot by pulling the paper up or down, on either the left or right hand side of the dispenser, as desired.

Importantly, the sheet holder of the present invention enables individuals to tear off sheets utilizing one hand thereby providing an aid to all persons including the handicapped or disabled.

BRIEF DESCRIPTION OF THE DRAWINGS

Other objects, features and advantages of the present invention will become more fully apparent from the following detailed description of the preferred embodiment, the appended claims and the accompanying drawings in which:

DETAILED DESCRIPTION OF THE PREFERRED EMBODIMENT

Figure 1:
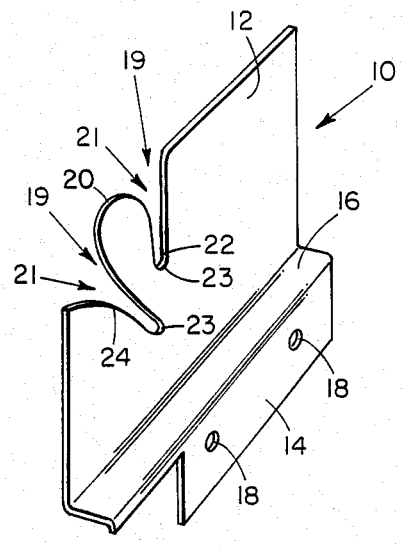
FIG. 1 is a plan view of a preferred embodiment of the one handed sheet holder of the present invention.

The preferred embodiment of the present invention is illustrated by way of example in FIGS. 1–10. With specific reference to FIG. 1, a sheet holder 10 includes a top 12 and a bottom 14. Bottom 14 is conformed to be attached to an ordinary sheet dispenser known in the art and disclosed more fully in FIG. 2. Bottom 14 is set apart from top 12 by right angle section 16. Bottom 14 has attachment holes 18 through which attaching devices such as screws, bolts, etc. (not shown) may be inserted for attaching sheet holder 10 to a dispenser.

Top 12 has at least one retaining slot 19. The preferred embodiment shown in FIG. 1, however, shows two retaining slots 18 formed by means of a rounded guide 20 whereby vertical slot 22 and angled slot 24 are formed. Slots 19, 22 and 24 have wide openings 21 and narrow endings 23.

Figure 2:
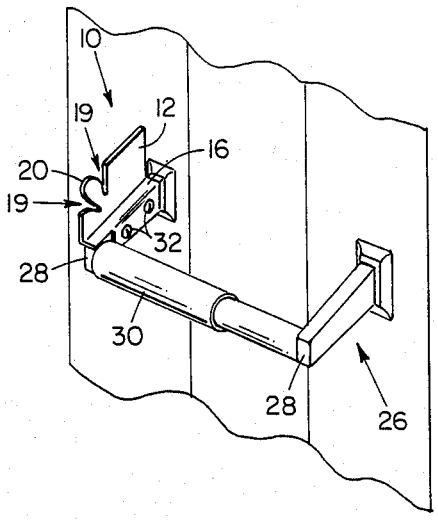
FIG. 2 is a plan view of the invention attached to the left hand side of a standard toilet roll dispenser with the slots facing upward.

FIG. 2 shows a standard roll dispenser 26 with oppositely positioned support arms 28 which support free rolling roll holder 30, known in the art and not disclosed further hereafter. As shown in FIG. 2, right angle section 16 of sheet holder 10 is conformed to fit on top of one of the oppositely positioned support arms 28. By means of attaching devices 32, screws, bolts, and the like, sheet holder 10 has been attached so that retaining slots 18 are facing upward on the left hand side of standard roll dispenser 26.

Figure 3:
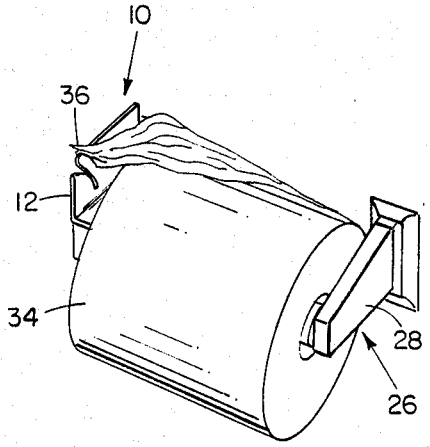
FIG. 3 is a plan view of the invention showing tissue trapped in the retaining slot.

FIG. 3 shows standard roll dispenser 26 with a roll of toilet paper 34 located thereon. As shown in FIG. 3, toilet paper 34 has been introduced into vertical slot 22 of sheet holder 10 and a section of toilet paper 34 removed from the roll. Also illustrated is the fact that the end 36 of the roll of toilet paper 34 is captured in vertical slot 22 and retained there for retrieval when more toilet paper 34 is desired.

Figure 4:
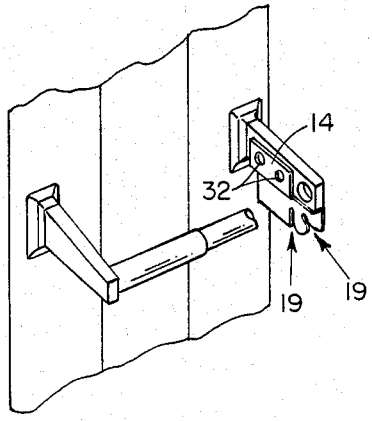
FIG. 4 is a plan view of the invention shown attached to the right hand side of a typical dispenser with the slots facing downward.
Figure 5:
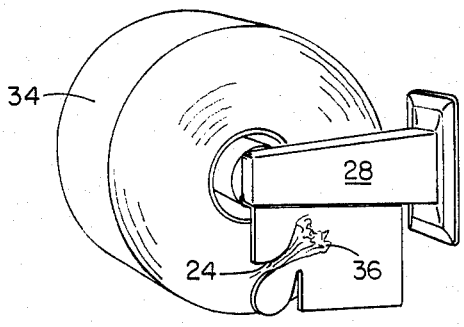
FIG. 5 is a plan view of the invention in place on the right hand side of a dispenser showing the toilet paper captured in the downward facing slots.

FIGS. 4 and 5 show the preferred embodiment of the sheet holder 10 in FIG. 1 attached to the right support arm 28 of standard roll dispenser 26 with slots 18 facing downward. FIG. 5 shows the end 36 of the roll of toilet paper 34 captured in angled slot 24 and ready for retrieval and use in obtaining more toilet paper 34 when desired.

Figure 6:
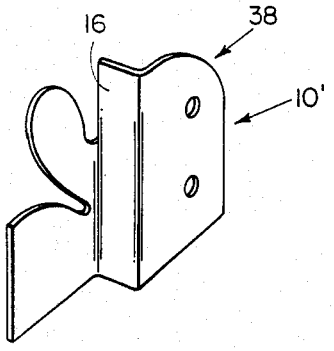
FIG. 6 is a plan view of another embodiment of the invention showing the sheet holder conformed for insertion into a recessed dispenser.
Figure 7:
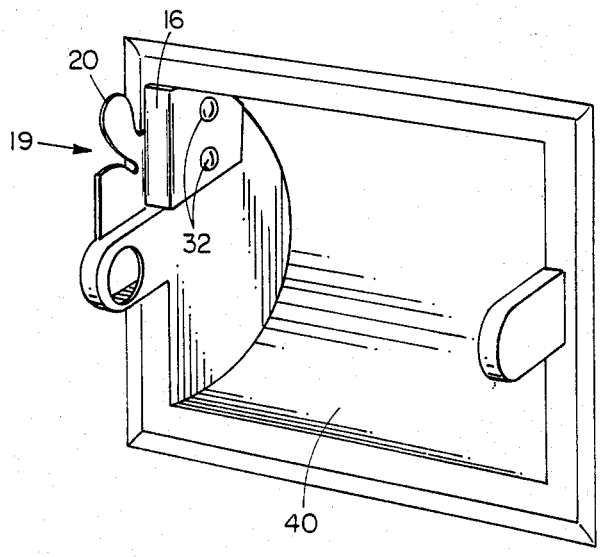
FIG. 7 is a plan view of the invention secured in place on the left hand side of a recessed holder with the slots facing upwards.
Figure 8:
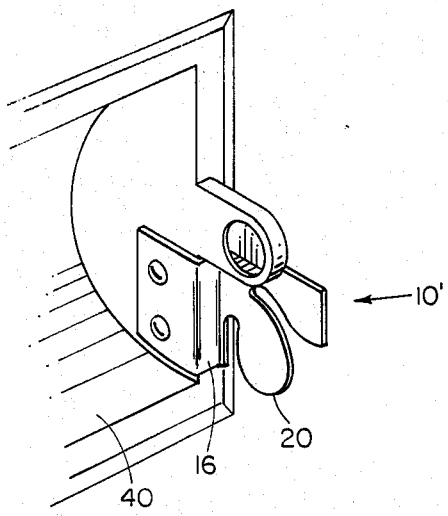
FIG. 8 is a partial plan view of the invention shown in place on the right hand side of a recessed dispenser with the slots facing downward.

Turning now to FIGS. 6, 7, and 8, another embodiment of the preferred invention is shown whereby the bottom 14 of sheet holder 10 is repositioned for use in a recessed dispenser 40, shown in FIGS. 7 and 8. Other than the relocation of bottom 14 90 degrees in a clockwise manner, the only difference is conforming rounded portion 38 designed to fit within recessed dispenser 40. FIG. 7 shows the embodiment illustrated in FIG. 6 attached to recessed dispenser 40 to the left hand side of dispenser 40 with slots 18 facing upward in just the same manner as in FIGS. 2 and 3. FIG. 8 shows the sheet holder 10 of FIG. 6 located on the right side of recessed dispenser 40 with slots 18 facing downward in the same manner as shown in FIGS. 4 and 5.

Figure 9:
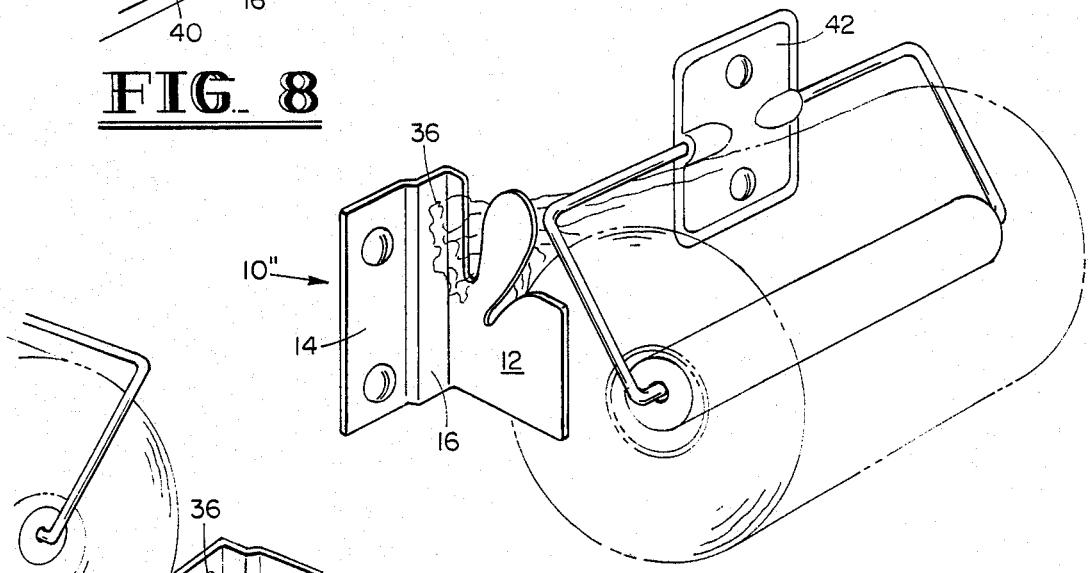
FIG. 9 is a plan view of another embodiment of the invention shown wall mounted on the left hand side of a dispenser with the slots facing upwards.
Figure 10:
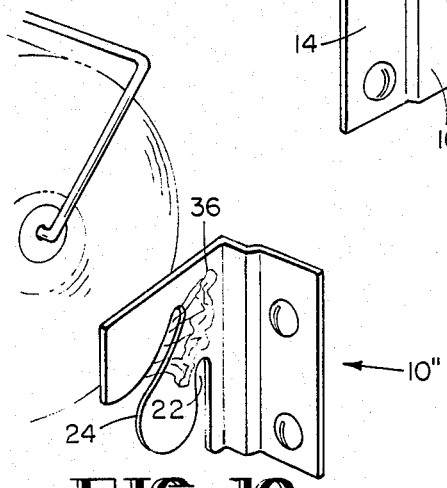
FIG. 10 is a partial plan view of the invention attached to the wall on the right hand side of a dispenser with the slots facing downward.

FIGS. 9 and 10 illustrate another preferred embodiment of the invention for use with a simplified version of standard roll dispenser 26 supported by a single support means 42. As shown in FIGS. 9 and 10, this embodiment of sheet holder 10 has a greatly shortened right angle section 16 thereby forming a bottom 14 essentially at right angles to top 12. In this configuration, sheet holder 10 is not attached to roll dispenser 26, 40, and the like but is, rather, attached to a wall, support and the like (not shown) directly adjacent to dispenser 26. FIG. 9 shows this embodiment of sheet holder 10 to the left of dispenser 26 with the slots 18 facing up and end 36 captured in vertical slot 22. FIG. 10 shows this embodiment of sheet holder 10 attached to the wall to the right of dispenser 26 with the slots 18 facing downward and with end 36 captured in angled slot 24.

In operation, bottom 14 of sheet holder 10 is attached to the left side of a standard roll dispenser 26 with retaining slot 18 facing upward. The user would grasp the end 36 of the roll of toilet paper 34 with one hand, pull the desired amount of paper from the free rolling roll holder 30 as desired, guide the edge of the toilet paper 34 into retaining slot 18, either vertical slot 22 or angled slot 24, and pull downward. As a result of the downward pull, the toilet paper 34 is forced from the wide opening 21 to the narrow ending 23 where the toilet paper 34 bunches, is captured and may be separated with a simple pull. As a result, the end 36 of toilet paper 34 is captured and retained in position for easy access and use in obtaining more toilet paper 34 when desired.

Sheet holder 10 may be placed on the opposite side in the reverse direction so that toilet paper 34 may be captured in slots 18 by pulling the toilet paper 34 into slots 18 in an upward direction and repeating the process as described above.

As disclosed, the sheet holder 18 may be utilized with recessed dispensers 40 or other variations of wall mounted roll dispensers 26, as shown in FIG. 9.

Obviously, sheet holder 10 may be utilized with any mounted roll dispenser known in the art, such as paper towels and the like.

As a result, the present invention provides a unique sheet holder that does not diminish the free rolling nature of dispensers known in the art. Further, the sheet holder 10 of the present invention enables individuals, handicapped or otherwise, to easily retrieve the amount of paper desired single handedly. Further, the sheet holder of the present invention readily locates the end 36 of a toilet paper 34 for easy access and use in obtaining further sections of toilet paper 34 when desired. As a result, individuals, and people with arthritis or other dexterity problems, no longer need to fumble around the roll 34 seeking the end 36.

While the present invention has been disclosed in connection with the preferred embodiment thereof, it should be understood that there may be other embodiments which fall within the spirit and scope of this invention as defined by the following claims.

What is claimed is:

1. A one handed sheet holder comprising:

A. a removably attachable, non-obstructive, unitary sheet holding means with a top and a bottom;

B. said bottom conformed to be attached along side of a sheet dispensing means containing a roll of detachable sheets; and C. said top containing a sheet retaining slot with a wider opening and a narrower ending so that with one hand a user can grasp a free hanging end of said detachable sheets and introduce a section of said sheet into said wider opening of said sheet retaining slot and force sid section of sheet to said narrow ending causing said sheet to bunch, tear apart, and leave an end of said sheet in said slot and a portion of said sheet in said user's hand.

2. The one handed sheet holder of claim 1 wherein said bottom is conformed and attached to a recessed sheet dispensing means.

3. The one handed sheet holder of claim 1 wherein said bottom is conformed and attached to a surface adjacent to said sheet dispensing means.

4. The one handed sheet holder of claim 1 wherein said top contains a first and a second slot formed by a rounded guide means located between said first and second slots and constructed so that said first slot is vertical and said second slot is angled.

5. A method of providing a one handed sheet holder comprising the steps of:

A. forming a removably attachable, non-obstructive, unitary sheet holding means with a top and a bottom;

B. attaching said bottom along side of a sheet dispensing means;

C. loading said sheet dispensing means with a roll of detachable sheets;

D. constructing a slot in said top with a wider opening and a narrower ending;

E. grasping a free hanging end of said detachable sheets and introducing a section of said detachable sheets into said opening; and F. pulling said section to said ending so that said section bunches, tears apart, and leaves one end of said roll of said detachable sheet captured in said slot and a detached section in a user's hand.

6. The method of claim 5 wherein constructing a slot further comprises the step of forming a first and second slot by forming a rounded guide means located between said first and second slots and constructed so that said first slot is vertical and said second slot is angled.

* * * * *